United States Patent [19]

Lorett et al.

[11] Patent Number: 4,678,404

[45] Date of Patent: Jul. 7, 1987

[54] LOW VOLUME VARIABLE RPM SUBMERSIBLE WELL PUMP

[75] Inventors: Jerzy A. Lorett, Beaumaris, Australia; Joseph E. Vandevier, Claremore, Okla.

[73] Assignee: Hughes Tool Company, Houston, Tex.

[21] Appl. No.: 822,358

[22] Filed: Jan. 24, 1986

Related U.S. Application Data

[63] Continuation-in-part of Ser. No. 546,719, Oct. 28, 1983, abandoned.

[51] Int. Cl.[4] ..... F04B 49/06

[52] U.S. Cl. ..... 417/45; 417/53; 417/424; 415/501

[58] Field of Search ..... 417/42–45, 417/53, 410, 424; 415/501; 166/53, 65 R, 68

[56] References Cited

U.S. PATENT DOCUMENTS

| | | | |
|---|---|---|---|
| 3,551,072 | 12/1970 | Zimmerly | 417/45 |
| 3,563,672 | 2/1971 | Bergstrom | 417/45 |
| 3,568,771 | 3/1971 | Vincent et al. | 166/65 R |
| 3,751,192 | 8/1973 | Boyd | 417/45 X |
| 3,779,457 | 12/1973 | Cornyn, Jr. et al. | 417/63 X |
| 3,985,467 | 10/1976 | Lefferson | 417/42 X |
| 4,177,649 | 12/1979 | Venema | 417/43 X |
| 4,284,943 | 8/1981 | Rowe | 166/53 X |
| 4,309,871 | 1/1982 | Venema | 417/43 X |
| 4,370,098 | 1/1983 | McClain et al. | 417/53 X |
| 4,511,312 | 4/1985 | Hartwig | 417/45 |

OTHER PUBLICATIONS

The Berkeley Pump Company Brochure, "Submersible Pumps," Bulletin 1205, 1956.

*Primary Examiner*—Carlton R. Croyle
*Assistant Examiner*—Paul F. Neils
*Attorney, Agent, or Firm*—James E. Bradley

[57] ABSTRACT

A low volume submersible pump assembly has features to stabilize the operation. The pump assembly includes a centrifugal pump driven by a submerged electrical motor. The centrifugal pump has an impeller configuration that is designed for high specific head, but potentially unstable operation. At the design speed, the pump potentially could deliver an indeterminate flow rate for a given head. Also, at the design speed, the design flow rate will yield a design head that is very close to the maximum head at zero flow. The pump has the characteristic of requiring a significant increase in torque to produce higher flow rates. To stabilize the potentially unstable pump, a variable speed drive varies the speed of the motor to maintain constant torque. Maintaining a constant torque allows a considerable variance in head with only a small variance in flow rate resulting.

5 Claims, 12 Drawing Figures

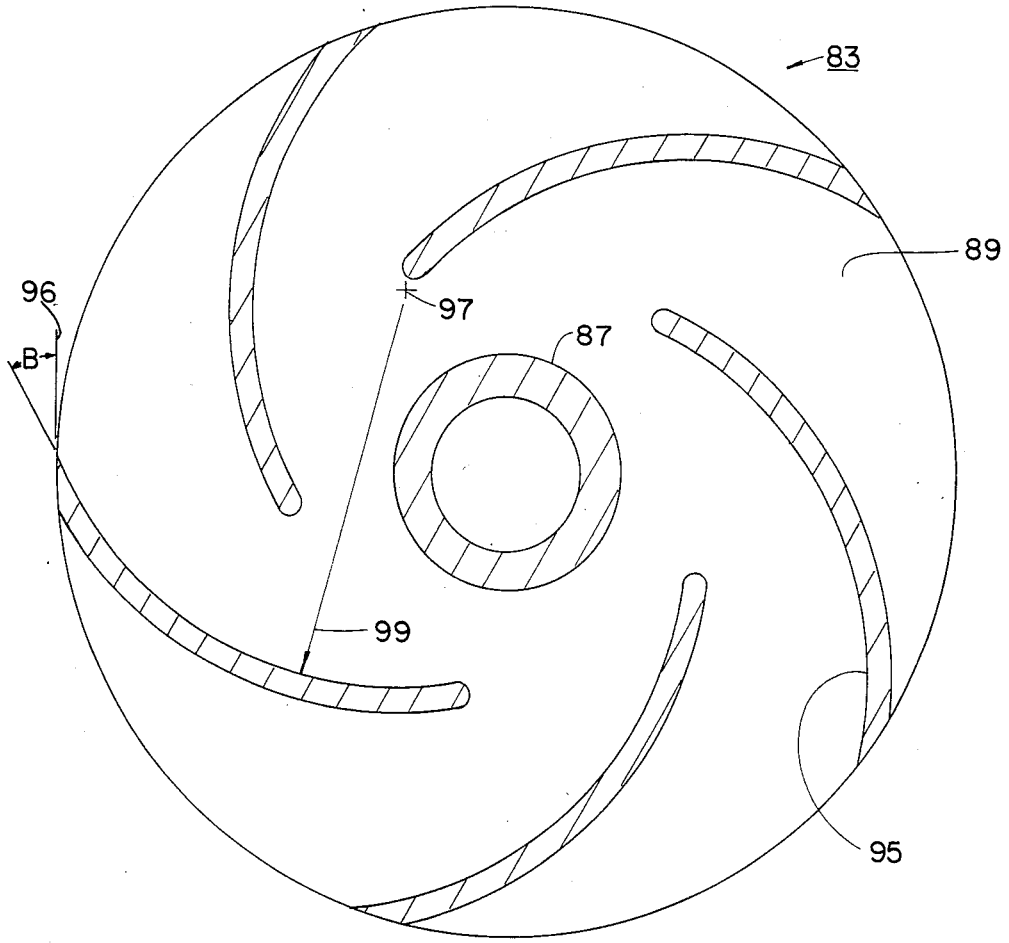
(PRIOR ART) FIG 10
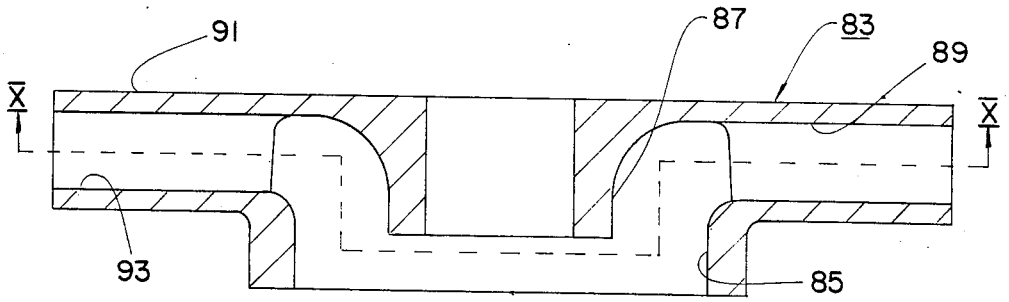
(PRIOR ART) FIG 9

LOW VOLUME VARIABLE RPM SUBMERSIBLE WELL PUMP

CROSS-REFERENCE TO RELATED APPLICATION

This is a continuation-in-part of application Ser. No. 546,719, filed Oct. 28, 1983, now abandoned.

BACKGROUND OF THE INVENTION

1. Field of the Invention

This invention relates in general to submersible well pumps and in particular to a low volume submersible pump that has an impeller configuration designed for high specific head coefficient.

2. Description of the Prior Art

Submersible pumps of the type concerned herein are used in oil wells and in deep water wells. The submersible pump assembly includes an electric motor located in the well. The shaft of the motor extends through a seal section to drive a centrifugal pump. The pump delivers well fluid to the surface through tubing. A power supply at the surface is connected to the electrical pump motor for supplying power. In some installations, variable speed drive systems at the surface allow the operator to vary the frequency and voltage being supplied to the motor to vary the speed of the motor. Also, varying the speed to maintain a constant current and torque on the motor is not unknown.

Relatively low volume pumps, 50–300 barrels per day, are not as efficient as they could be theoretically. The impeller vanes can be oriented to provide theoretically a high stage head. However, although efficient, the pump would be unstable. The resulting shape of the pump output head versus flow rate curve would have a portion that is nearly horizontal. This horizontal portion would result in for a given head, more than one possible flow rate. Because of unknown well characteristics, the pump could shift between flow rates and even stop pumping, causing damage to the pump. As a result, artificial losses are built into these low volume pumps to create more of a downwardly sloping head/flow rate curve. While this stabilizes the pump, the pump will be less efficient and produce less head per stage.

SUMMARY OF THE INVENTION

In this invention, a low volume pump is deliberately designed to provide a potentially unstable operation. The impeller stages are designed for maximum head, with the result that the head/flow rate curve has a nearly horizontal portion. A low volume, high stage head pump, however, fortunately has the characteristic of an increasing torque with flow rate. The increase is sufficient such that an optimum or design torque can be selected at a point of high efficiency on the head/flow rate curve. This design torque in a low volume pump of this nature can be achieved at various different speeds, each of which would provide a different flow rate.

Utilizing this characteristic enables one to stabilize the pump operation by maintaining the torque at a constant level, preferably the design or optimum level. The torque is maintained by a variable speed drive which senses the current and maintains constant current. The flow rate and head will change. Maintaining the torque constant at the optimum level prevents the pump from operating at more than one flow rate for a given head. The result is a stable, high head, low volume pump.

DESCRIPTION OF THE DRAWING

FIG. 9 is vertical cross-sectional view of a prior art impeller which will produce a stable output.

FIG. 10 is cross-sectional view of the impeller of FIG. 9 taken along the line IX—IX of FIG. 9.

DESCRIPTION OF THE PREFERRED EMBODIMENT

Figure 1:
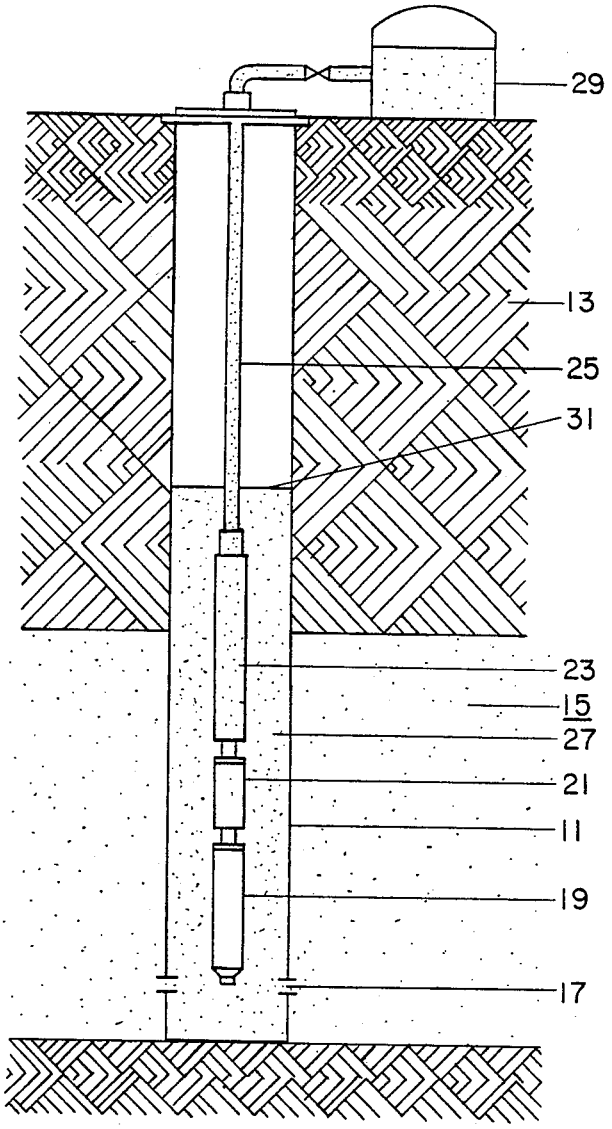
FIG. 1 is a schematic view of a submersible pump assembly.

Referring to FIG. 1, well casing 11 is located within a well in earth formation 13 and also passes through a producing zone 15. Perforations 17 formed in the well casing 11 enable the fluid in the producing zone 15 to enter the casing 11.

The submersible pump assembly includes an electrical motor 19 which is located in the well. The shaft of motor 19 extends through a seal section 21 and is connected to a centrifugal pump 23. Pump 23 is connected to tubing 25 for conveying well fluid 27 to a storage tank 29 at the surface. The casing 11 will contain an operating fluid level 31 in the annulus of the casing 11. The pump 23 must be capable of delivering fluid for the distance from level 31 to the surface tank 29. It is common to refer to the output pressure of the pump 23 in terms of head, which is a linear measurement in feet. Pressure can be converted to head by dividing the pressure by the specific gravity and multiplying the result by 2.31, which is the amount of feet head equivalent to one pound per square inch of pressure. The flow rate of the pump 23 is normally expressed in barrels per day or gallons per minute. The torque output of the motor to drive the pump can be expressed in terms of foot pounds. Also, torque can be converted to horsepower, which is 33,000 foot pounds per minute.

Figure 2:
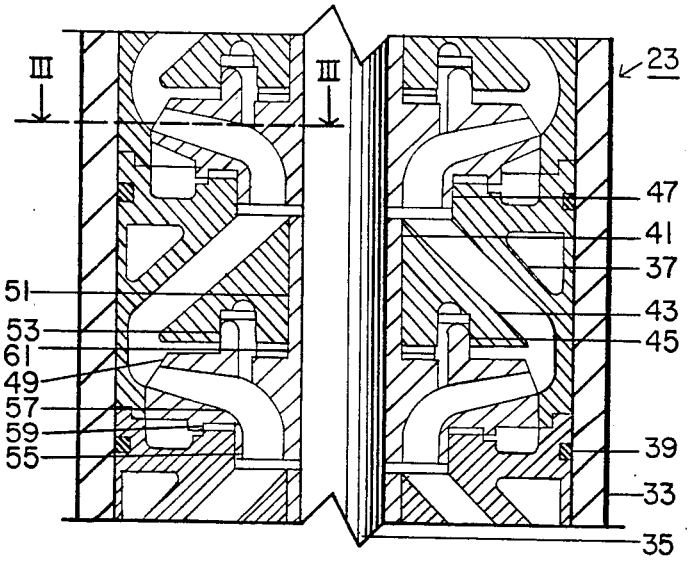
FIG. 2 is a partially sectioned view of the pump of a conventional pump assembly.

Referring now to FIG. 2, pump 23 includes a cylindrical housing 33. A shaft 35 extends longitudinally through the pump 23. Diffusers 37 are of conventional design. Each diffuser 37 has an outer wall that engages the inner wall of housing 33 and is sealed by an O-ring 39. Each diffuser 37 has an inner portion containing a bore 41. A plurality of passages 43 extend through each diffuser 37. On the lower side of each diffuser 37, an annular groove 45 is formed. An annular cavity 47 is located on the upper side of each diffuser 37.

An impeller 49 is carried within each diffuser. Impeller 49 includes a hub 51 that extends the length of impeller 49 and is in engagement with shaft 35. Hub 51 is tubular, with its outer wall being closely received within the bore 41 of the diffuser 37. Each impeller 49 has an annular balance ring 53 that extends upwardly and is slidingly carried inside annular groove 45. A skirt 55 is formed on the lower portion of impeller 49 and is rotatably received within the cavity 47 of the diffuser immediately below. A plurality of passages 57 extend from the skirt 55 upwardly and outwardly to register with the diffuser passages 53. Washers or rings 59 are placed between a lower portion of each impeller 49 and diffuser 37. Washers or rings 61 are located between an upper portion of each impeller 49 and diffuser 37.

The impeller 49 rotates with the shaft 35, increasing the velocity of the fluid as the fluid is discharged radially outward through each of the passages 57. The pressure increases as the fluid is drawn through the stationary diffuser 37 and brought back to the intake of the next stage impeller 49. With large numbers of impellers 49 and diffusers 37, high pressure can be achieved at the output of the pump.

Figure 3:
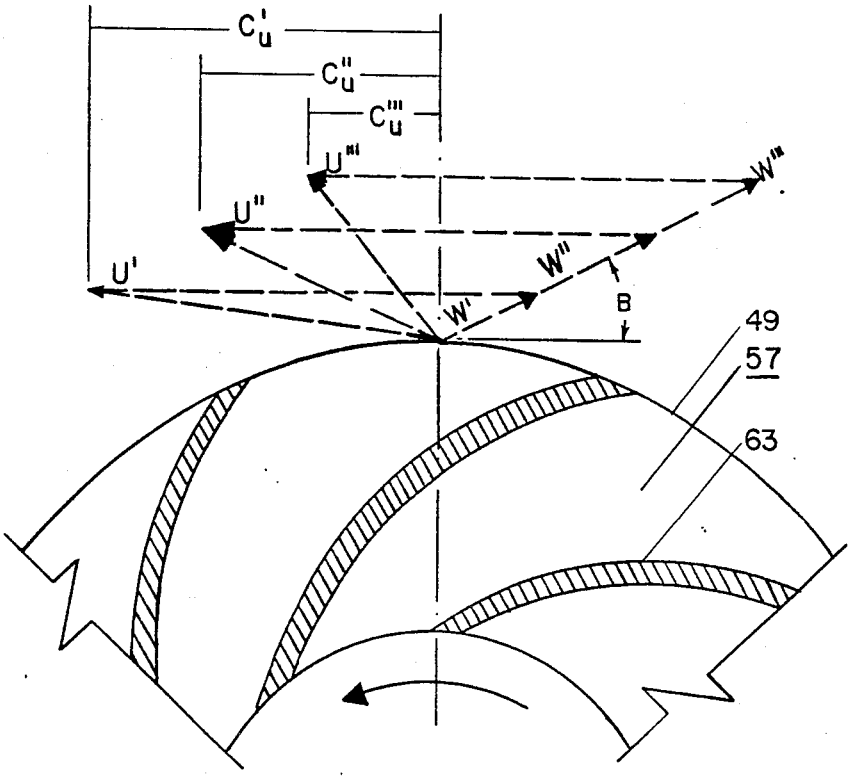
FIG. 3 is a sectional view of one of the impellers of the pump of FIG. 2 shown removed from the pump and taken along the line III—III of FIG. 2.

Referring to FIG. 3, each impeller passage 57 has as sidewalls outwardly curved vanes 63 between which the fluid is discharged to the next upward diffuser 37. The fluid is discharged at an exit angle B, which is determined by the angle of the vanes 63. The angle B is measured with respect to a line drawn tangent to the impeller 49 at a reference point on the periphery. Three relative velocities of the exiting fluid are indicated by the lines W′, W″, and W‴. The flow rate at the lowest relative velocity W′ is less than the flow rates at the relative velocities W″ and W‴. Regardless of flow rate, the relative velocities W′, W″, and W‴ will be approximately in the same direction. A peripheral velocity U′, U″, and U‴ is always tangent to the impeller 49 at the reference point on the periphery. Unlike the relative velocities W′, W″, and W‴, the peripheral velocities U′, U″, and U‴ remain at a constant magnitude for a constant rotational speed. The relative velocities W′, W″, and W‴, however, will differ for different flow rates, even though the speed of the impeller 49 remains constant. The flow rates may change due to change in the system resistance, even though the speed remains constant. The tangential components Cu′, Cu″, and Cu‴ are the distances between a radial line passing through the reference point and the termination of the peripheral velocities U′, U″, and U‴. A higher relative velocity W, which occurs due to a higher flow rate, creates a lower tangential component Cu.

It is known that the energy imparted by the impeller to the flow is equal to the speed U times the tangential component Cu divided by a constant. As a result, higher flow rate causes a lower Cu and thus a lower input energy. It is also known that increasing the angle B will increase the tangential component Cu and result in an increase in the energy imparted above that possible with a conventional low angle B. Consequently, theoretically a low flow rate, high ratational speed pump with a high angle B would provide a high specific head low volume pump. A high specific head coefficient is desirable. The specific head coefficient is the ratio of the stage head over the peripheral velocity U of the impeller 49.

Figure 4:
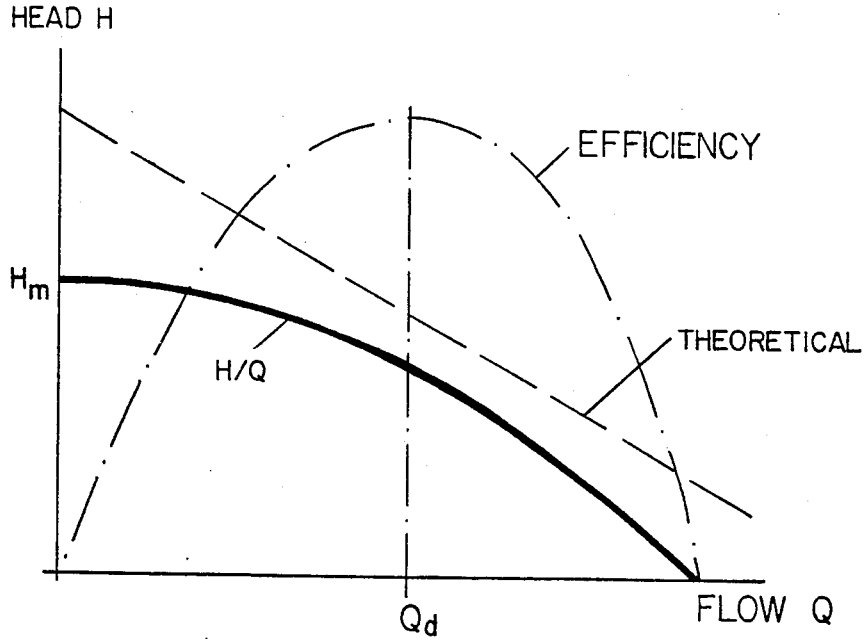
FIG. 4 is is a drawing of a head/flow rate curve of a typical pump.

Referring to FIG. 4, the head H versus flow rate Q line in a 100% efficient pump will be represented by the line labeled "theoretical". This line is a straight, constant slope line based on a constant speed pump. That is at constant speed, as the head H is increased, the flow Q linearly decreases. At constant speed, the head H could be increased by decreasing the size of a choke, which is a passage through which the flow must pass at the surface. Decreasing the diameter of the choke passage in turn would decrease the flow rate.

Because of friction and flow separation losses, the actual output is indicated by the lower curve H/Q. The difference between the lower curve H/Q and the theoretical lines represents losses in efficiency. The efficiency curve is shown on FIG. 4, with a maximum being at the point where the H/Q curve is closest to the theoretical line. The minimum efficiencies are at the points near maximum flow on one end and maximum head on the other end. Ideally, a pump would be operated at the flow rate Qd, which is at the point of maximum efficiency. The pump head can be increased even more by providing a pump with a theoretical line having a lesser slope. As indicated by the previous relationship between the energy imparted and the tangential component Cu, the slope of the theoretical line can be reduced by increasing the angle B.

Figure 5:
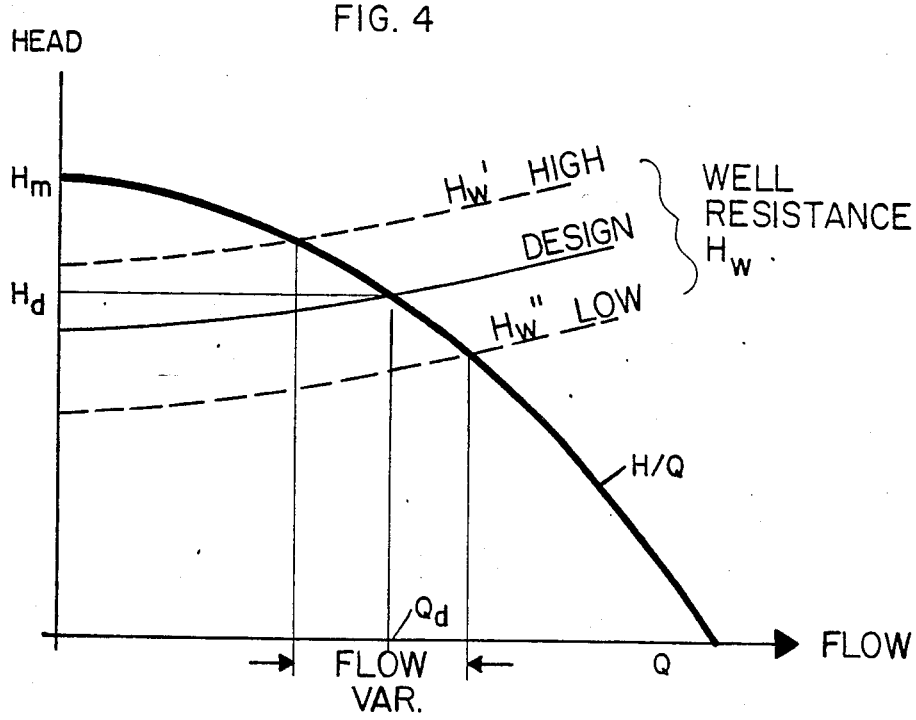
FIG. 5 is a drawing of a typical head/flow rate curve for a medium or high volume pump.

FIG. 5 illustrates a constant speed H/Q curve for a pump installed in a well. Changes in the well draw down and losses in the tubing and pipes leading to the surface tank 29 (FIG. 1) due to friction create resistances, increasing the head in the same manner generally as would occur if a smaller choke were used. The curve labeled "design" indicates the theoretical well resistance for a particular well. However, because of differences in tubing condition and other factors normally not accurately known, the pump must be able to cope with departures from design conditions. The curve labeled Hw′ indicates the maximum well resistance expected and the curve labeled Hw″ indicates the minimum well resistance that could be expected. This results in a flow variation as indicated by the arrows on either side of the selected optimum flow rate Qd. The optimum Qd will be selected as the intersection of the design well resistance with the H/Q curve. This will result in a pump design head Hd. The maximum head output of the pump Hm results at zero flow rate Q. The highest pump head expected, corresponding to the Hw′, is still below the maximum head Hm, thus there should be little danger of zero flow occurring. The well resistance curves can be readily plotted from published information.

The location of the design point Hd must be such that a variation in the well resistance Hw does not result in too large of a variation in pump flow Q. In particular, the pump head Hm at or near zero flow must be sufficiently higher than the design head Hd, so that an increase in well resistance, by say 25%, does not cause zero flow. In pump of moderate and high flows, this condition is achieved by placing the design head Hd some 30% or lower than the maximum head Hm at zero flow. A reasonably high relative velocity W (FIG. 3) assures that the tangential component Cu will vary considerably as the flow Q varies. This considerable variance provides a slope to the H/Q curve, shown in FIG. 4, that is sufficiently high such that Hd may easily be selected 30% or so lower than Hm.

Figure 6:
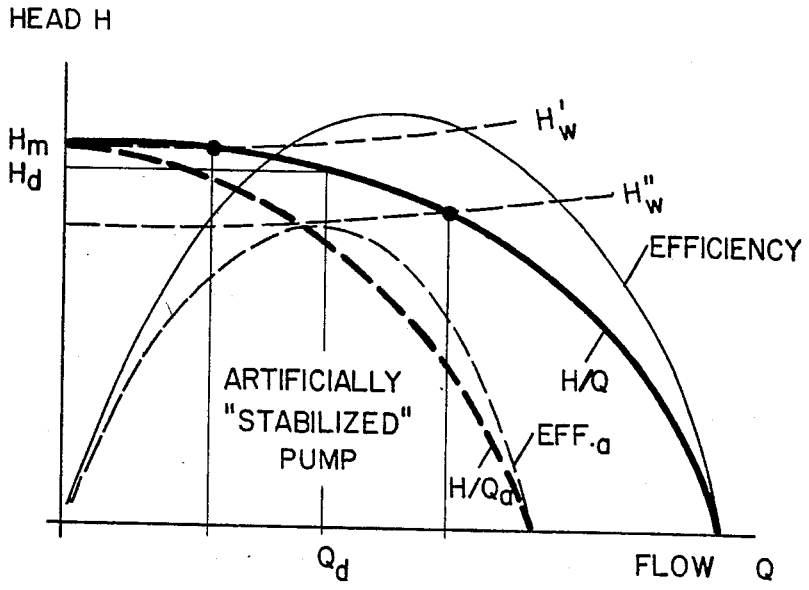
FIG. 6 is a drawing of a head/flow rate curve for a low volume pump, shown before and after artificial losses have been designed into the pump.

A problem arises in pumps designed for low flows, such as 50 and 300 barrels per day. While theoretically, very small impellers 49 running at very high speeds could be made to the same geometrical proportion as larger pumps, practical considerations of channel blockage by well solids, casting inaccuracies, surface finish and others, necessitate the use of passages much larger than the hydraulically optimum size. In consequence, the velocity W, which is proportional to the flow rate Q, is very small compared to the peripheral velocity U. This results in a tangential component Cu that is large, but which varies little with the velocity W and thus the flow rate Q. As a result, the head output curve H/Q is horizontal for a fairly wide range of flow as illustrated in FIG. 6. The output curve H/Q could thus provide for a given head, and a constant speed, more than one flow rate Q. The indeterminate flow rate Q for a given head makes the pump unstable.

Also, as shown in FIG. 6, the flatness of the H/Q curve results in a design head Hd that is very close to the maximum Hm, certainly not 30% less as shown in the drawing of FIG. 5, which would be for a medium or large volume pump. The design flow rate Qd is located between the intersection of the two well resistance curves Hw' and Hw''. If the higher well resistance Hw' was encountered, the pump would reach a zero flow condition, possibly damaging the pump.

The conventional way to stabilize a low volume pump is to intentionally introduce internal losses that increase with the flow Q, thus steepening the pump characteristic H/Q. For example, one might put blockages in the diffuser or reduce the impeller angle B. The dotted line H/Qa indicates a H/Q curve that has been steepened by artificial losses. The dotted line Effa shows the efficiency for the curve H/Qa. The result is thus a reduction of the design head and also a lower efficiency.

Figure 8:
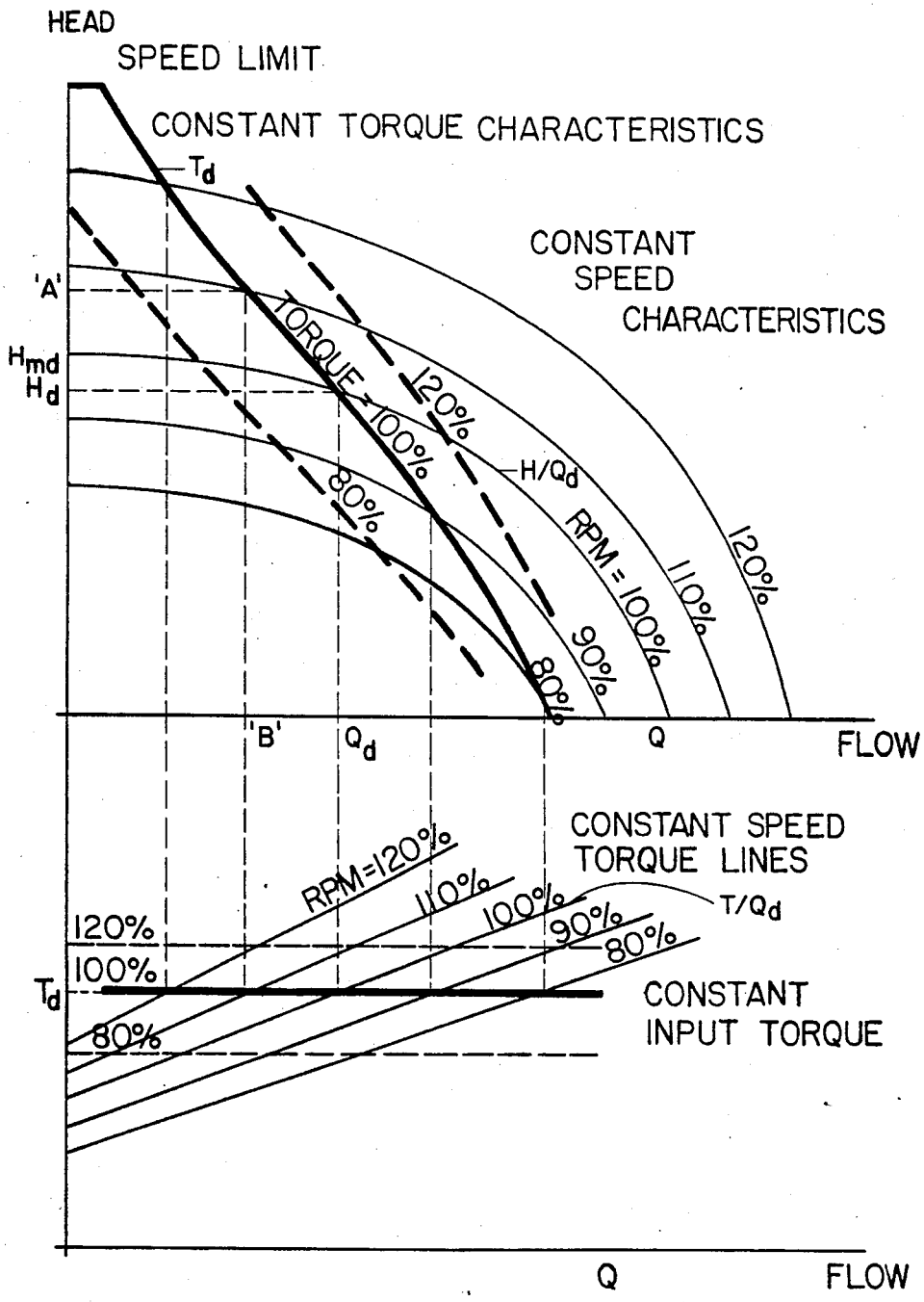
FIG. 8 is a combined drawing of head/flow rate at different speeds and torque/flow rate at different speeds for a low volume pump constructed in accordance with this invention.

FIG. 8 illustrates the solution to the control of a pump with a H/Q curve that is too flat over too wide a flow range. The upper portion of the diagram of FIG. 8 illustrates H/Q curves that are similar to the H/Q curve of FIG. 6. The H/Q curve labeled H/Qd and "RPM=100%" is a curve plotted while the pump is operating at a constant design speed. The H/Qd curve is fairly flat over the range beginning at zero flow to the design flow Qd. Qd is the design flow rate that has been selected by choosing a point of high efficiency on the efficiency curve, which is not shown in this figure, but is similar to the curve shown in FIG. 4. This results in a design head Hd that is very near the intersection of the H/Qd curve with zero flow rate, which is the maximum head Hmd at the design speed.

The other H/Q curves in FIG. 8 labeled 80%, 90%, 110% and 120% represent the performance of the pump converted to different speeds by known similarity laws. For example, the curve labeled "80%" is plotted at a motor speed 80% of the design speed indicated by the 100% curve H/Qd. The curve labeled 120% is the H/Q curve plotted when operating the motor at 120% of the selected design speed.

The lower portion of FIG. 8 represents a plot of the motor torque or input torque to the pump versus flow rate. This lower plot could be plotted on the upper portion of FIG. 8, but is shown below for clarity. It is a known characteristic that pumps with steep angle B have a constant speed torque that increases as the flow rate increases and the head decreases. Many larger pumps designed for shallow angle B and therefor lower specific head, however, have a fairly flat torque curve. The constant speed torque lines labeled 80%, 90%, 100%, 110%, and 120% each show the increase in torque that occurs as the flow rate increases at various constant pump speeds. For example, the 100% line T/Qd is the torque line measured at the design speed. This curve is calculated or plotted empirically by decreasing the head and increasing the flow while measuring the torque input at the pump design speed. The other curves are measured at rotational speeds of 80%, 90%, 110%, and 120% of the design speed. Each torque line is an approximate straight line that has a significant positive slope.

If the previously selected design flow, Qd is projected down to intersect the torque line T/Qd, this would be the design torque Td. The straight line indicated by Td indicates the design torque and could be expressed in terms of foot pounds, if desired. It is significant that this design torque can be reached over a wide range of heads merely by varying the speed. The design torque line intersects the 120% speed torque line, as well as the 80% speed torque line. For example, if the design rotational speed was 3600 rpm, one would be able to reach the design torque Td at any point between 2,880 rpm and 4,320 rpm.

By drawing projecting lines from the intersections of the constant speed torque lines with the design torque line Td, one is able to project to the upper portion of FIG. 8, the torque at a constant level and variable speeds. The two dotted lines, indicated by the numerals 80% and 120%, indicate constant torque at 80% and 120% of the magnitude of the design torque Td. All three of the constant torque variable speed lines shown in the upper portion of FIG. 8 are almost linear and slope at a rather high negative rate. The slope is far greater than the H/Q curves from zero flow to design flow. This is advantageous since one can see that by varying the speed to maintain the torque at a selected level, one could stabilize the flow even though all of the constant speed H/Q curves are fairly flat. On the other hand, if the pump speed could not be varied, and if increased head was encountered, because of the proximity of the design operating head Hd with the head Hmd at shutoff at design speed, one could easily encounter zero flow rate, possibly damaging the pump. Also, in the portion of the H/Qd curve near zero flow rate, the flow Q could fluctuate considerably at constant head H because of the flatness of the curve.

However, by keeping the torque constant, the speed will increase and this condition would not occur. For example, if the head H increased to point A, the speed would increase to 110% of design speed and the flow Q would decrease only to point B. This flow Q is still above zero flow. In other words, in a well of nominal resistance equal to Hd, a constant speed pump with a characteristic as shown in FIG. 8 could only cope with a very slight increase in well resistance and would stop pumping at all when the resistance reached the value of shutoff Hmd. In contrast, the proposed combination of a steep impeller angle and constant torque input, reacts to an increased resistance by an increase in pump speed and head, and so can stably overcome a very significant increase in the well resistance.

Figure 7:
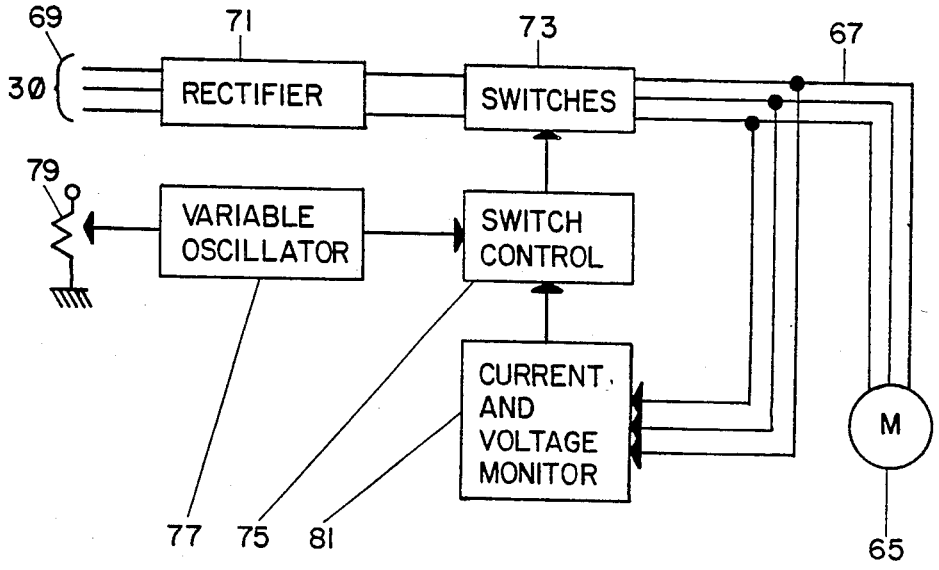
FIG. 7 is a schematic view of a variable speed drive system for a submersible pump.

FIG. 7 illustrates a system that will accomplish the result diagramed in FIG. 8. Variable speed drive systems to maintain a constant torque are currently available, One system which is capable of accomplishing this objective is described in U.S. Pat. No. 4,467,258, John M. Leuthen, issued Aug. 21, 1984, all of which material is incorporated by reference. As shown in FIG. 7, basically such a system has a three-phase electrical motor 65 connected by three power cables 67 to a three-phase power source 69 at the surface. A rectifier 71 is connected to the three cables for changing three phase AC voltage to a positive rail and a negative rail DC voltage. A set of switches 73 alternately switches the positive and negative DC rails into the power lines 67, reconstructing an AC voltage for delivery to motor 65. A switch control circuit 75 controls the frequency that the switches 73 are switched on and off. A variable oscillator 77 controls the frequency of the switch control circuit 75. Oscillator 77 is controlled by a potentiometer 79. Setting the potentiometer 79 to a particular setting will determine the frequency of the switches 73, and thus the frequency being supplied to the motor. The voltage is also varied in proportion to the frequency selected. A current and voltage monitor monitors the current and has a feedback to the switch control circuit 75. Maintaining constant current on a motor essentially maintains constant torque. The current voltage monitor 81 will control the switch control circuit 75 to maintain the constant desired current.

To utilize this invention, one must select a centrifugal pump of a high speed head, i.e. steep angle B such that its torque increases significantly with flow at constant speed. This would exist particularly in a pump with a capacity between 50 and 300 barrels per day. The impeller of the pump should be designed for maximum efficiency with a high angle B, as shown in FIG. 3, at least 35 degrees and preferably between 45 degrees and 60 degrees.

Figure 12:
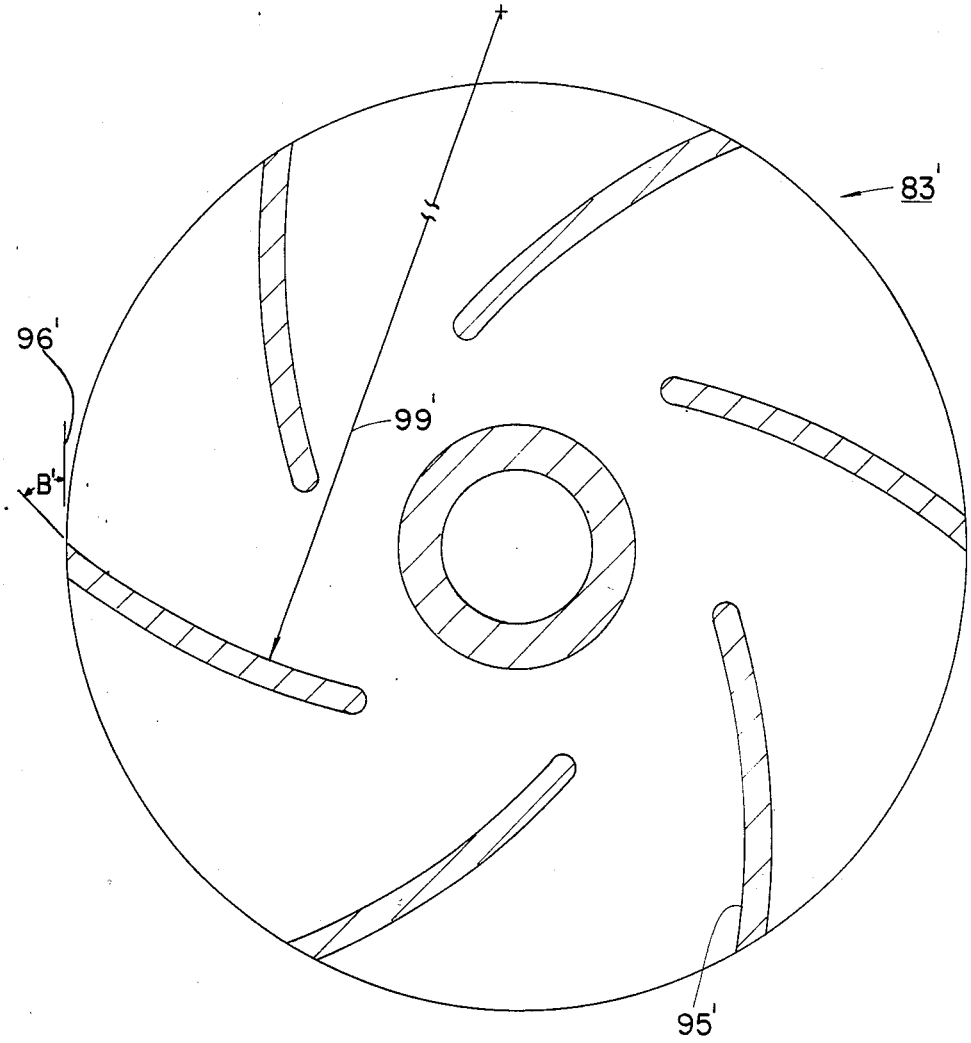
FIG. 12 is a cross-sectional view of the impeller of FIG. 11, taken along the line XII—XII of FIG. 11.
Figure 11:
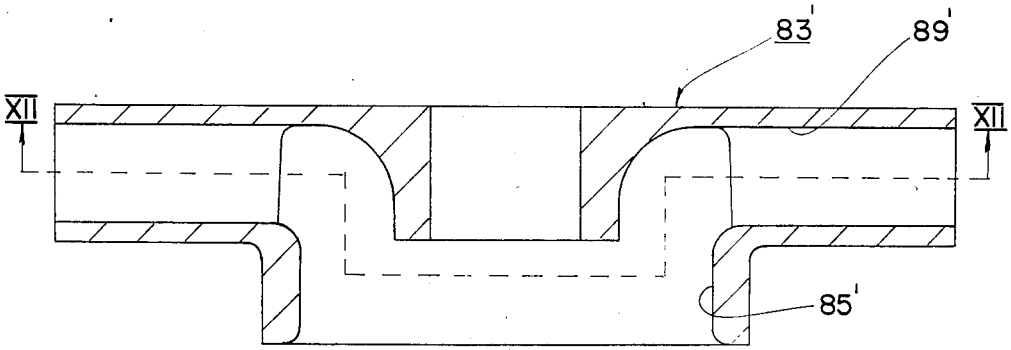
FIG. 11 is a vertical cross-sectional view of an impeller constructed in accordance with this invention, and which is capable of producing an unstable output.

FIGS. 11 and 12 illustrate a preferred embodiment of an impeller for a high efficiency pump which will produce instability unless controlled as set forth in this application. FIGS. 9 and 10 show, for comparison purposes, an conventional impeller of the same size, but which would produce a stable output. Referring to FIGS. 9 and 10, the impeller 83 has an intake port or eye 85 on a lower end. A hub 87 is centrally located for receiving a shaft (not shown) which rotates the impeller 83. The eye 85 leads to five impeller passages 89 which discharge the liquid radially outward into the diffuser (not shown) located immediately above. The passages 89 are defined by flat upper and lower surfaces 91 and 93. Vanes 95 separate the upper and lower surfaces 91 and 93 and provide the sidewalls for each passage 89.

In the embodiment shown, the impeller 83 could be of a 3 inch or 4 inch outer diameter, and it has five vanes. Each vane 95 intersects at an exit angle B a line 96 drawn tangent to the periphery at the point of intersection. For the stable impeller 83 of FIGS. 9 and 10, the exit angle B is preferably 25 degrees. Each vane 95 extends from the outer diameter inwardly to the eye 85. The diameter of eye 85 is rougly 45 to 50% the outer diameter of the impeller 83. The 25 degree exit angle B results in each vane 95 having a radius 99 for a 4 inch impeller 83 that is approximately 1.65 inch. The radius is drawn from centerpoint 97, which will be located within the impeller 83, approximately at the periphery of the eye 85.

The impeller 83' in FIGS. 11 and 12 is capable of producing at least two flow rates for a selected head at low flows. The numerals for the components in the impeller 83' in FIGS. 11 and 12 will be the same as shown in FIGS. 9 and 10, except for a prime symbol. Impeller 83' has the same eye 85' diameter, and the same outer diameter. It has the same number of passages 89', and each passage 89' has the same vertical height as the passages 89 in FIG. 9. There are the same number of vanes 95' as vanes 95. The vanes 95', however, have an exit angle B' with respect to tangent line 96' that is 55 degrees. This results in a radius 99' that is much greater than the radius 99, providing vanes 95' that are much straighter. For a 4 inch outer diameter, the radius 99' is about 3.14 inch, with the centerpoint (not shown) being located exterior of the outer diameter of the impeller 83'. Impeller 83', if 3 inches in diameter, is capable of producing about 15 feet of head per stage and would be used in stages to produce about 50 to 300 barrels per day.

The pump with impellers 83' will produce a head/flow curve that has an almost horizontal portion beginning at zero flow and extending significantly into the flow range. The maximum head Hmd (FIG. 8) at zero flow rate and the design speed will not be more than 20% greater than the design head Hd at the design speed. The pump with impellers 83' will produce a variable speed constant design torque line Td that when plotted with a constant speed head/flow curve, as shown in FIG. 8, has a greater negative slope than the design head/flow curve H/Qd in the range from zero flow to design flow Qd.

A design or preferred rotational speed should be selected at about 3600 rpm or greater. A design head Hd and design flow rate Qd should be sleceted, based on a point of high efficiency and expected well resistances. The design head Hd at design speed should be greater than 80% the maximum head Hmd at the design speed. A design torque Td should be selected by projecting the design flow Qd to the torque-flow plot. The design torque Td will be the torque at which the torque at design speed T/Qd is intersected by the design flow rate Qd. This design torque should be plotted, as shown in FIG. 8 on the head/flow graph. The head/flow graph should be expanded to show the H/Q curves for various constant speeds. The constant torque line Td' projected to the head/flow rate curves shows how the speed must be varied with changes in head to maintain the constant torque. The steep downward slope of the constant torque line Td indicates that a wide range in head variance will cause only a relatively small change in flow rate, thus stabilizing the pump operation.

In operation, the low volume pump described above will be connected with the variable speed drive system, shown schematically in FIG. 7. The motor will be set by the controls 77 and 79 to operate at the design torque, which corresponds to a selected constant current. The feed-back to the switch control circuit 75 will cause the control circuit to vary the speed of the switches 73 and thus the motor 65 to maintain the constant current selected. The torque will remain constant despite variances in head.

The invention has significant advantages. The pump is more efficient and has fewer stages for a given overall head. Controlling the pump at constant torque makes it stable. The variable speed drive is conventional and capable of maintaining the torque at the designed level. Such a system lends itself to low volume wells, which at present, is handled in the great majority by beam type surface pumps. Such a system would be more efficient and less troublesome than these beam type pumps.

While the invention has been shown in only one of its forms, it should be apparent to those skilled in the art that it is not so limited but is susceptible to various changes without departing from the scope of the invention.

I claim:

1. A submersible pump assembly comprising in combination:

a centrifugal pump having impeller means for producing at least two flow rates for a selected head when operated at constant speed, making the pump potentially unstable, and for requiring increasing torque to produce increasing flow rates;

an electric motor connected directly to the pump for driving the pump;

sensing means for sensing the torque output of the motor; and variable speed drive means for varying the speed of the motor in response to the torque sensed by the sensing means to maintain a constant torque output, the constant torque applied to the pump preventing the pump from delivering more than one flow rate for a given head to stabilize the operation.

2. A submersible pump assembly, comprising in combination:

a centrifugal pump having impeller means for producing a constant design speed head/flow curve with a design flow rate and a design head selected such that the maximum head at zero flow rate and the design speed is no more than about 20% greater than the design head at the design speed, rendering the pump potentially unstable at the design speed, and for requiring an increase in torgue as the flow increases;

an electric motor connected to the pump for driving the pump;

sensing means for sensing the torque output of the motor; and variable speed drive means for varying the speed of the motor in response to the torque sensed by the sensing means to maintain the torque constant at a selected torque for stabilizing the pump operation.

3. A submersible pump assembly comprising in combination:

a centrifugal pump having impeller means with an exit angle in the range from 45 to 60 degrees for producing a constant design speed head/flow curve with a design flow rate and a design head selected such that the maximum head at the design speed and zero flow rate is no more than about 20% greater than the design head at the design speed, rendering the pump potentially unstable at the design speed due to unexpected increases in head, and for producing a constant variable speed torque line that when plotted on a constant speed head/flow graph with a head/flow curve, has a greater negative slope than the head/flow curve in the range from zero flow to design flow;

an electric motor connected directly to the pump for driving the pump;

sensing means for sensing the torque output of the motor; and variable speed drive means for varying the speed of the motor in response to the torque sensed by the sensing means to maintain the torque constant at a selected level for stabilizing the pump operation.

4. A method of pumping a well with a submersible pump assembly comprising in combination:

providing a centrifugal pump with potentially unstable impellers of a type that will produce at least two flow rates for a selected head;

connecting an AC electric motor directly to the pump for driving the pump;

locating the pump and motor in the well and providing electrical cables that extend to the surface;

connecting the cables to an electrical variable speed drive located at the surface, which is of a type that will vary the speed of the motor by varying the frequency of the electrical power supplied;

sensing the torque output of the motor; and varying the variable speed drive and thus the speed of the motor to maintain constant torque output of the motor, the constant torque output applied to the pump, preventing the pump from delivering more than one flow rate for a given head, to stabilize the operation.

5. A method of pumping a well with a submersible pump assembly comprising in combination:

providing a centrifugal pump with potentially unstable impellers, each impeller being of a type having vanes with an exit angle in the range from 45 degrees to 60 degrees so as to produce at least two flow rates for a selected head;

connecting an AC electric motor directly to the pump for driving the pump;

locating the pump and motor in the well and providing electrical cables that extend to the surface;

connecting the cables to an electrical variable speed drive located at the surface, which is of a type that will vary the speed of the motor by varying the frequency of the electrical power supplied;

sensing the current supplied to the motor; and varying the variable speed drive and thus the speed of the motor to maintain constant current, which produces a constant torque output of the motor, the constant torque output applied to the pump preventing the pump from delivering more than one flow rate for a given head, to stabilize the operation.

* * * * *